US006073793A

United States Patent [19]

Apps et al.

[11] Patent Number: 6,073,793

[45] Date of Patent: Jun. 13, 2000

[54] STACKABLE LOW DEPTH BOTTLE CASE

[75] Inventors: William P. Apps; Philip C. Hwang, both of Alpharetta, Ga.

[73] Assignee: Rehrig Pacific Company, Los Angeles, Calif.

[21] Appl. No.: 09/097,933

[22] Filed: Jun. 16, 1998

[51] Int. Cl.[7] ..... B65D 21/00

[52] U.S. Cl. ..... 220/509; 206/203; 206/509; 206/518; 220/516; 220/519; 220/771; 220/DIG. 15

[58] Field of Search ..... 220/509, 511, 220/516, 517, 518, 519, 513, 771, DIG. 15; 206/139, 203, 427, 503, 504, 509, 511, 518, 519, 821

[56] References Cited

U.S. PATENT DOCUMENTS

| | | | |
|---|---|---|---|
| 2,512,855 | 6/1950 | Erickson | 220/512 |
| 2,526,335 | 11/1950 | Deichert | 220/509 |
| 2,530,481 | 11/1950 | Rawn, Jr. | 220/DIG. 15 |
| 2,970,715 | 2/1961 | Kappel et al. . | |
| 3,055,531 | 9/1962 | De Chelbor | 220/771 X |
| 3,055,542 | 9/1962 | Russo . | |
| 3,247,996 | 4/1966 | Garcia . | |
| 3,392,869 | 7/1968 | Needt . | |
| 3,416,694 | 12/1968 | Bebb | 220/518 |
| 3,428,207 | 2/1969 | Schoeller | 220/519 X |
| 3,812,996 | 5/1974 | Bunnell . | |
| 4,162,738 | 7/1979 | Wright | 206/504 X |
| 4,344,530 | 8/1982 | deLarosiere . | |
| 4,538,742 | 9/1985 | Prodel | 220/518 X |
| 4,899,874 | 2/1990 | Apps et al. . | |
| 4,911,303 | 3/1990 | Andersson | 206/509 |
| 4,978,000 | 12/1990 | Apps et al. . | |
| 5,096,085 | 3/1992 | Eek et al. | 206/427 X |
| 5,651,461 | 7/1997 | Apps et al. . | |
| 5,660,279 | 8/1997 | Apps et al. | 206/509 X |
| 5,823,376 | 10/1998 | McGrath | 220/516 |
| 5,842,572 | 12/1998 | Apps et al. | 206/511 X |
| 5,855,277 | 1/1999 | Apps et al. | 220/516 X |

FOREIGN PATENT DOCUMENTS

| | | | |
|---|---|---|---|
| 1350962 | 12/1963 | France | 220/DIG. 15 |
| 2302244 | 9/1976 | France | 206/427 |
| 758817 | 10/1956 | United Kingdom | 220/DIG. 15 |

*Primary Examiner*—Allan N. Shoap
*Assistant Examiner*—Joe Merek
*Attorney, Agent, or Firm*—Brooks & Kushman P.C.

[57] ABSTRACT

A stackable case for retaining and transporting bottles includes outer side walls forming an outer shell, a case bottom disposed substantially within the outer shell, and a plurality of supports for supporting the outer surfaces of the bottles. The side walls include a lower wall portion and a plurality of spaced upwardly projecting pylons, where four corner pylons define the four corners of the case. At least one upwardly projecting column is generally disposed within the outer shell, and defines, in combination with the case bottom, the side walls and the end walls, a plurality of bottle retaining pockets. The columns and the pylons extend above the lower wall portions and below a top surface of the retained bottles. The end walls each include an integrally molded handle structure suspended between an upper portion of adjacent corner pylons to thereby define a generally open end wall area below the handle structure. The handle structure allows the bottle case to be manipulated with either a palm-up or palm-down orientation of the hand. The end walls further include an integrally molded structural reinforcement member extending between the adjacent corner pylons below the respective handle structure. The reinforcement members are sufficiently spaced from the respective handle structure to prevent interference with the grasping of the handle structure.

5 Claims, 11 Drawing Sheets

STACKABLE LOW DEPTH BOTTLE CASE

TECHNICAL FIELD

The present invention relates to a low depth stackable bottle case for use in retaining and transporting bottles. More particularly, the present invention relates to beverage bottle cases that combine low depth with high stability for stored bottles, full label visibility for displaying purposes, an easily gripped handle structure, cross-locking ability for securing a plurality of stacks of empty cases, and an improved, structurally reinforced end design.

BACKGROUND OF THE INVENTION

Plastic bottles are widely used as containers for retailing soft drinks and other beverages. One type of plastic, polyethylene terephthalate (PET), has become particularly popular because of its transparency, light weight, and low cost. In addition to being flexible, the walls of PET bottles are strong in tension and, thus, can safely contain the pressure of a carbonated beverage. Moreover, conventional PET bottles can bear surprisingly high compressive loads, provided that the load is directed substantially along an axially symmetric axis of the bottle. A single PET bottle can support the weight of many bottles of the same size filled beverage if the bottle is standing upright on a flat horizontal surface and the weight of the other bottles is applied to the closure of the single bottle and is directed substantially vertically along the symmetrical axis. However, if a compressive load is applied to a conventional PET beverage bottle along a direction other than the symmetry axis of the bottle, the bottle tends to buckle. This tendency of conventional PET bottles to give way under off axis compressive loads is particularly pronounced for large capacity bottles, such as the two liter bottle widely used for marketing soft drinks.

Soft drink bottles are ordinarily packaged by bottlers in cases or other containers, several bottles to the case, for shipment to retailers or for storage. The term "case", "crate" or "tray" is used interchangeably herein to include all cases, crates, trays, and similar containers having a bottom and peripheral side wall structure. Cases of bottles are customarily stacked on top of each other. In storage warehouses, columns of cases are frequently stacked on pallets which can be lifted and moved about by forklift trucks. The stacks of cases on the pallets must, therefore, be particularly stable in order to remain standing in the face of the jostling inherent in being moved about. The technique for interconnecting stacks of empty cases, called "cross-stacking", is often used to improve the stability of empty cases layered on a warehouse pallet. Cross-stacking generally involves stacking rectangular bottle cases to build up a layered structure, with each layer having cases oriented parallel to each other and with the adjacent layers being oriented at right angles to each other. Thus, since the adjacent layers are perpendicular, each case in the cross-stacked layer rests on at least two cases in the layer below. As a result, the cases of the cross-stacked layer tends to keep the cases on which they rest from moving apart from each other. The cross-stacked layers, therefore, stabilize the stacked structure.

Because of the tendency of conventional PET beverage bottles to buckle under off-axis loads, attempts to stack cases of these bottles may fail. For example, bottles may tilt away from vertical alignment upon stacking if conventional partitioned cases having low side walls are used to contain the bottles. Tilted bottles in the lower cases of a stack may also buckle. Even absent buckling, the tendency of bottles to tilt in conventional low sided cases causes problems. Tilting, generally, places an undesirably low limit on the number of tiers in a stack since the tilting of bottles in one case can cause the next higher case in the stack to tilt. This leads to instability if too many tiers are included in the stack.

Previously, these problems were dealt with by packaging beverage bottles in corrugated paper cartons having high sides, often equal in height to the height of the bottles. Two liter PET bottles filled with soft drinks were often packaged in enclosed corrugated paper cartons for storage and shipment. Although the high sides of these paper cartons reduce the incidence of tilting and provide additional support when the cartons are stacked, the cartons are expensive. The cost of the cartons cannot ordinarily be distributed over a number of repeated uses since corrugated paper cartons generally are not rugged enough for reuse and, therefore, they are usually discarded by the retailer.

One solution to the problems of full depth corrugated paper cartons is plastic full depth cartons; that is, plastic cases having peripheral side walls approximately the same height as the bottles. In plastic full depth cases, the side walls are the load bearing surfaces. Full depth plastic cases, however, have numerous disadvantages. They are expensive to manufacture, they are expensive to ship and store empty in a warehouse as they require a large amount of space, and full depth cases also totally surround the bottles and prevent display of the bottles.

To overcome these problems, plastic low depth cases have been used. A low depth case is one in which the side walls are lower than the height of the stored bottles, and in which the bottles support the weight of additional cases stacked on top. However, these too have drawbacks. For example, some low depth cases require additional structure to hold the bottles and ensure complete bottle stability, even the case depth is more than 25 percent of the height of the bottles.

Various plastic reusable bottle carriers are known in the art. One reusable bottle carrier is disclosed in U.S. Pat. No. 3,055,542 to Russo. The bottle carrier can be made of a plastic, and is assembled from two pieces: a handle and a carrier body having six cups for soft drink bottles. In order to stack the bottle carriers when empty, the handles must be removed. This is very inconvenient and time consuming. The '542 bottle carrier is also seriously limited regarding stacking loaded carriers. It cannot be stacked in a conventional cross-stacked structure because, as illustrated therein, the spacing between the bottles and the carriers is different in the directions parallel and perpendicular to the handle of the carrier.

Kappel U.S. Pat. No. 2,970,715 is one of the earlier embodiments of molded plastic low depth bottle carrying cases. Each bottle rests on a raised surface within an individual compartment. The bottom of the case is formed with recesses for receiving bottle tops when loaded cases are vertically stacked. However, Kappel does not indicate the size of the carrying case relative to the bottles being carried.

In Bunnel, U.S. Pat. No. 3,812,996, a reusable plastic bottle carrying case for beer bottles is disclosed. The case is designed with a plurality of bottle compartments having flat bottom walls. The cases are designed to be cross-stacked; the cases are dimensioned so that the center to center distance between adjacent bottles within a case is the same as the center to center distance between adjacent bottles in adjacent cases in abutting relationship. Thus, the vertical axes of the bottles in adjacent layers are co-linear. Although a plurality of loaded carrying cases is designed to be vertically stackable with the weight of upper cases supported by the bottles within lower cases, the lower surface of the bottom wall of the case is flat. Thus, there is no structure for assuring a proper alignment or centering of one case with an upper or lower case.

Garcia, U.S. Pat. No. 3,247,996, discloses a plastic bottle container for milk bottles. The container is shorter than the bottles which extend above the top surface of the container walls. In Garcia, the bottles, rather than the walls of the container, are load bearing. Indented circular portions may be formed in the bottom wall to receive bottle tops when containers are vertically stacked. Like many prior art bottle carriers, the Garcia container has sides of reduced height from the those of a standard full depth case; also, it can be used with a variety of bottles. However, the case is not a low depth case and is more expensive than low depth cases. It also does not have the display capability of low depth cases.

A more recent attempt to solve the problem of providing reusable, low depth, cross-stackable PET bottle cases is disclosed in U.S. Pat. No. 4,344,530 to DeLarosiere. The '530 patent has many of the features and problems of Garcia and discloses a plastic PET bottle case that is cross-stackable and has a very low depth as shown in the figures. This low depth is disclosed as being approximately 2 inches. However, in practice, this depth is insufficient because the large degree of lateral instability does not prevent bottles from tipping over. Additionally, the bottle retaining pockets are required to have a raised angular bottle seat ring which fits within the inner indentation formed in the base of many bottles to ensure bottle stability. This does not permit all PET bottles to rotate within the bottle pockets for display purposes. Additionally, it does not permit one piece bottles (i.e., petaloid bottles that do not have a base indentation) to be adequately retained.

Commonly assigned U.S. Pat. Nos. 4,899,874 and 4,978,002, the contents of which are hereby incorporated by reference, disclose a low depth bottle case for two liter bottles that is cross-stackable when empty if the upper cross-stacked cases are properly positioned. In addition, in the embodiment disclosed, the substantially flat upper surface across the bottle retaining pockets permits one piece petaloid bottles and bottles with base indentations to be retained. The low height of the case side walls and the columns above the case side walls also allow the display of the bottle labels to the consumer. However, because of the low depth and the substantially flat upper surface across the bottle retaining pocket, a generally snug fit is required between the bottle pocket and the bottle and, therefore, there is a limit on the range of bottle diameters which can be retained in a stable stack.

The trend in the bottling industry today is to manufacture two-liter bottles as inexpensively as possible. This means reducing the amount of plastic in the bottle, but still maintaining sufficient bottle strength to support fully loaded cases stacked thereabove. In order to accomplish this task, the newest two-liter bottles are made to have smaller diameters and a slightly greater height than their predecessors. The result is a light weight two liter bottle having a slimmer overall profile than previous two liter bottles. The light weight bottle, however, due to its slimmer profile and increased height, does not perform ideally within the bottle pockets of the low depth two liter cases discussed above.

The low depth bottle case described in commonly owned U.S. Pat. No. 5,651,461, which is hereby incorporated by reference, has overcome many of the functional shortcomings described above with respect to the prior art, however further improvements are desirable, such as improved nesting capability, improved cross-stacking stability, improved carrying stability and improved structural integrity.

SUMMARY OF THE INVENTION

These and other problems of the prior art are overcome by the stackable low depth case of the present invention. In particular, the present invention provides such a stackable low depth case in which a handle structure is provided at opposing ends thereof which may be freely grasped about substantially the entire periphery thereof, and an integrally molded structural reinforcement member is provided below each handle for increased structural integrity, and is spaced sufficiently away from the respective handle structure to prevent interference with the grasping of the handle structure. Also, in one embodiment, bottle retaining pockets are formed in equally spaced groups of four within the case and between adjacent cases to provide 360° support for bottle caps in cone-type cap locating areas for improved cross-stacking stability.

More specifically, the stackable low depth case for retaining and transporting bottles has opposing side walls and opposing end walls that form an outer shell having a case bottom disposed substantially within the outer shell. The side walls include a lower wall portion and a plurality of spaced upwardly projecting pylons, including four corner pylons defining four corners of the case. A plurality of spaced upwardly projecting columns or a vertical rib structure is generally disposed within the outer shell and defines, in combination with the case bottom, the side walls and the end walls, a plurality of bottle retaining pockets. The end walls each include an integrally molded handle structure suspended between an upper portion of adjacent corner pylons to thereby define a generally open end wall area below the handle structure. The end walls further include an integrally molded structural reinforcement member extending between the adjacent corner pylons below the respective handle structure and sufficiently spaced away from the respective handle structure to prevent interference with the grasping of the handle structure.

The integrally molded structural reinforcement member adds significant structural integrity to the case, thereby improving the durability and useful life of the case.

In one embodiment, the plurality of bottle retaining pockets comprise two sets of four pockets configured to support two sets of four equally spaced bottles such that the two sets of four equally spaced bottles are separated by a separation distance (S), and such that each of said bottles are spaced from a peripheral edge of the case by a distance (D) which is one-half of the separation distance (S), thereby providing bottle alignment in cross-stacked cases.

Accordingly, an object of the invention is to provide an improved stackable low depth case with high stability for stored bottles, full label visibility for display purposes, an easily gripped handle structure, a stable cross-stacking ability, and improved structural integrity for long life.

The above object and other objects, features and advantages of the present invention are readily apparent from the following detailed description of the best modes for carrying out the invention when taken in connection with the accompanying drawings.

DETAILED DESCRIPTION OF THE PREFERRED EMBODIMENTS

A stackable low depth bottle case 10 is shown in FIGS. 1–5 in accordance with a first embodiment of the invention. The case 10 includes side walls 12, 14, and opposing end walls 16,18 which cooperate to form an outer shell. A case bottom 20 is disposed substantially within the outer shell. Side walls 12,14 are relatively long and extend the length of the case 10, whereas end walls 16,18 are relatively short and extend the width of the case 10. The case 10 is rectangular and is, therefore, symmetric about both centerlines which bisect the bottom surface. The depth or height of side-walls 12, 14, 16, 18 is relatively low compared to the height of the bottles retained therein. The ratio of the length of side walls 12,14 to the length of end walls 16,18 is substantially equal to the ratio of the number of bottles the case holds in the lengthwise direction to the number of bottles the case holds in the widthwise direction. For example, an 8 bottle case is approximately twice as long as it is wide and holds bottles in a 4×2 relationship.

Figure 4:
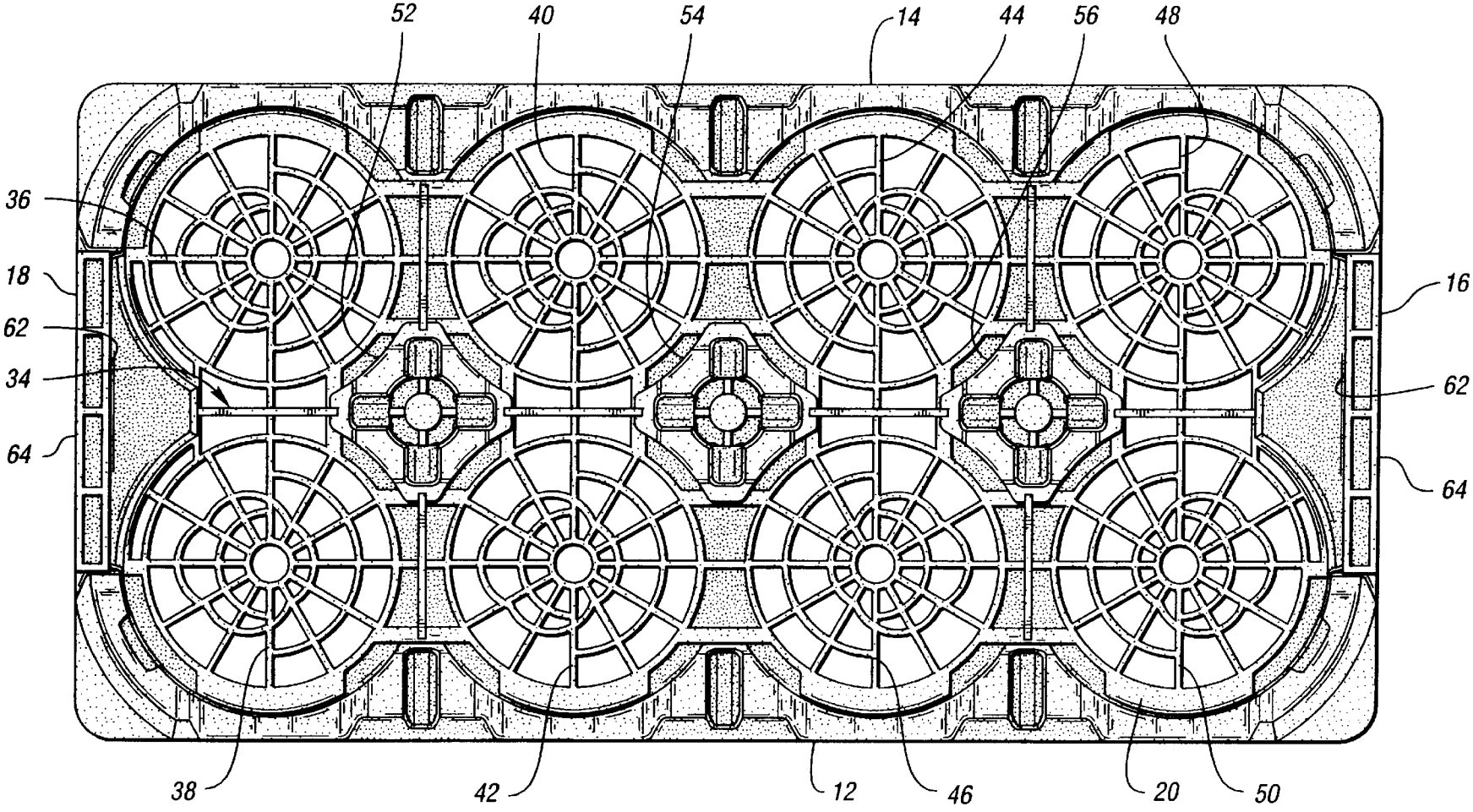
FIG. 4 shows a top plan view of the case of FIG. 1.
Figure 5:
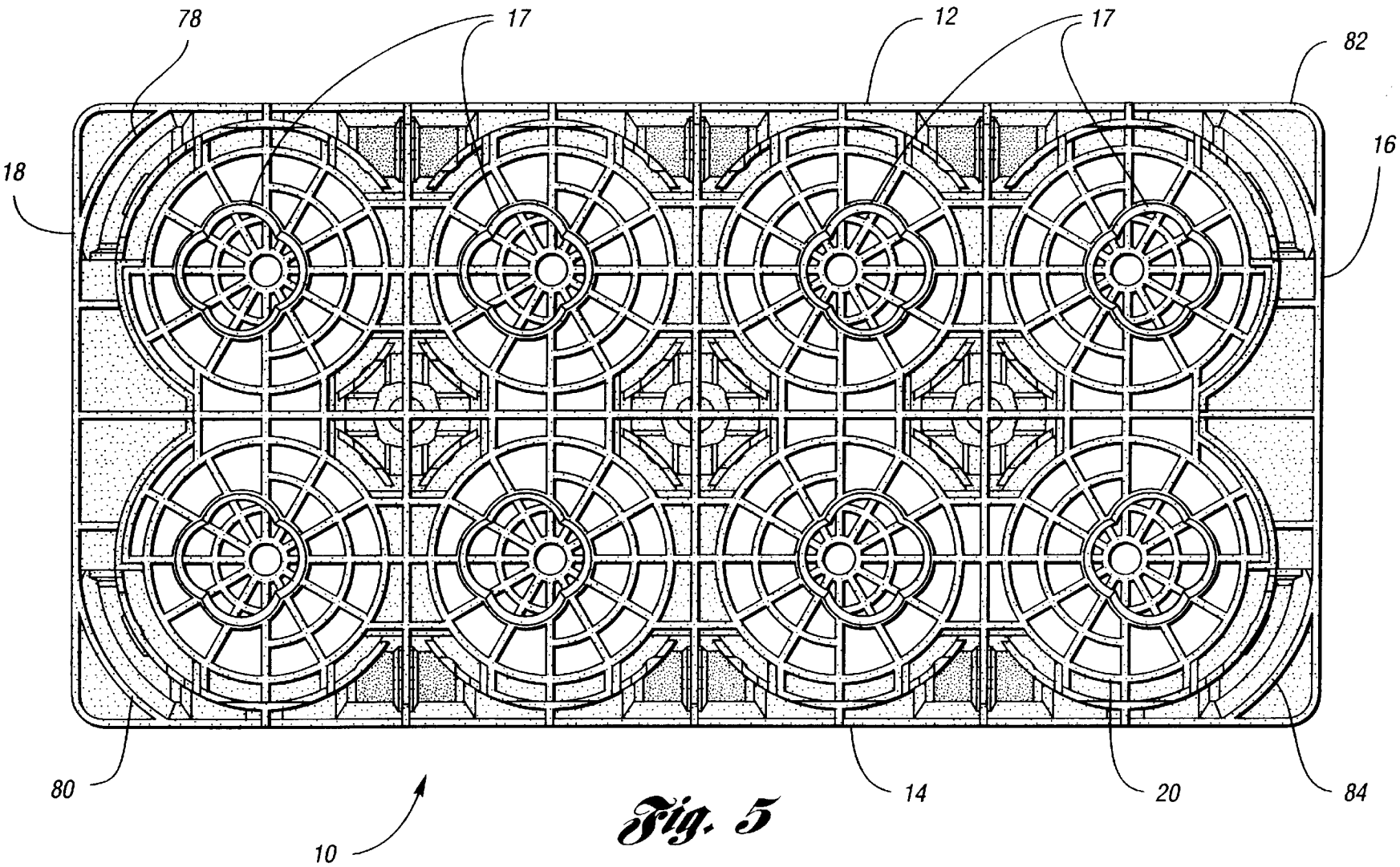
FIG. 5 shows a bottom view of the case of FIG. 1.

As best shown in FIGS. 4 and 5, the floor structure or case bottom 20 is attached to side walls 12,14 and end walls 16,18 to form the outer shell of the case 10. Preferably, the case 10 is made from plastic and is molded integrally as a single component.

Figure 1:
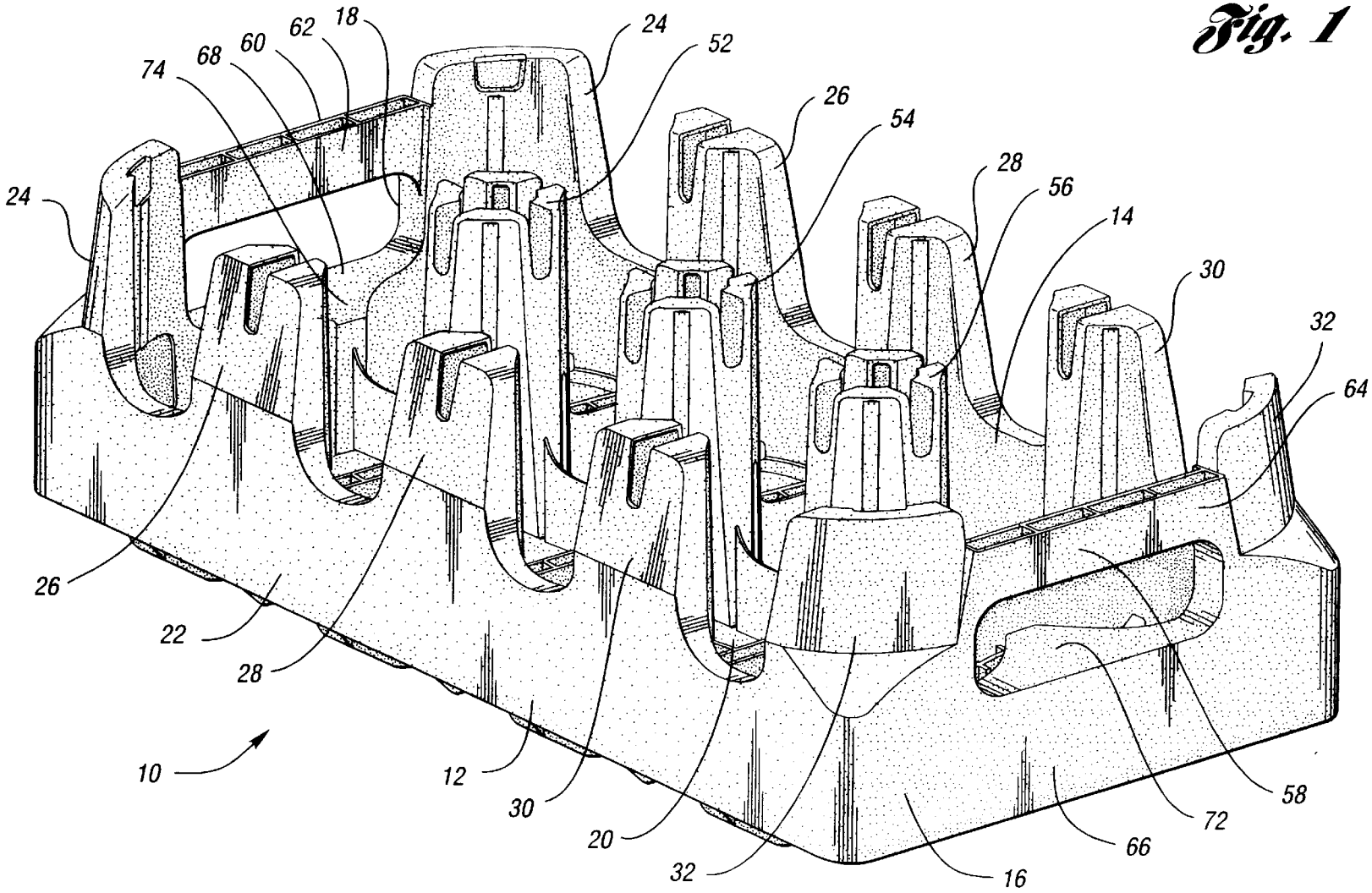
FIG. 1 shows a perspective view of a stackable low depth case in accordance with the present invention.
Figure 2:
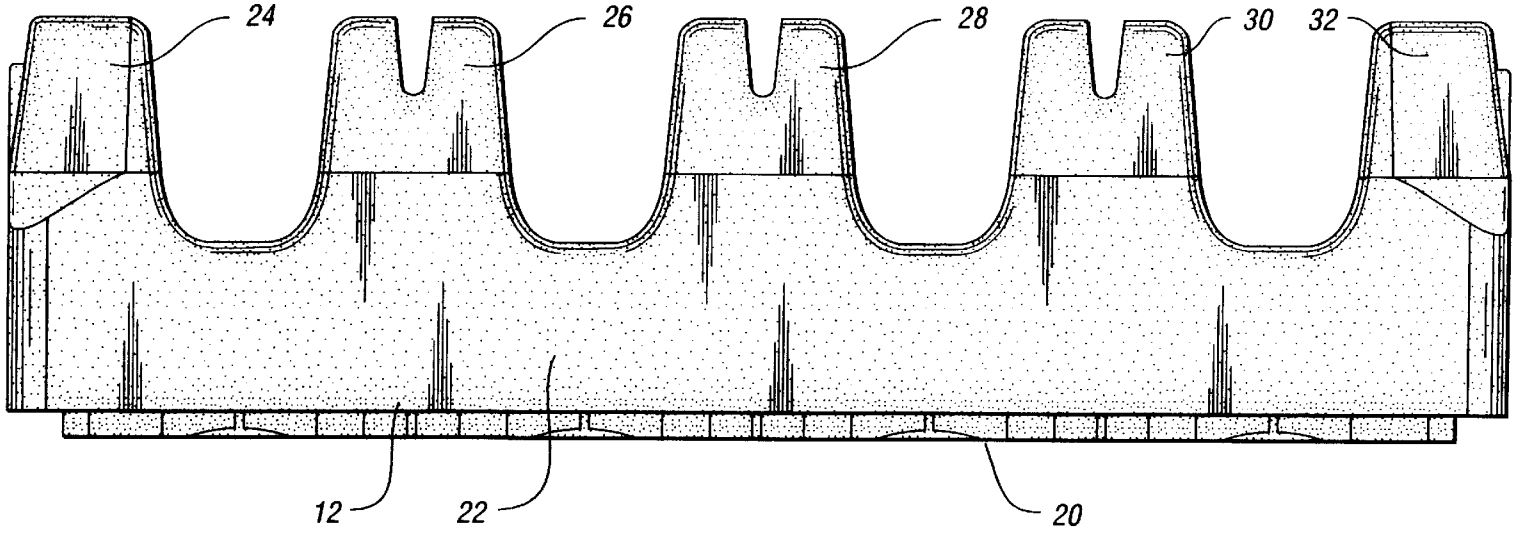
FIG. 2 shows a side-view of the case of FIG. 1.

As shown in FIGS. 1 and 2, the side walls 12,14 each include a lower wall portion 22 and a plurality of spaced upwardly projecting pylons 24, 26, 28, 30, 32, including the four corner pylons 24, 32 defining four corners of the case 10.

As shown in FIG. 4, a vertical rib structure 34 is, generally, disposed within the outer shell, and defines, in combination with the case bottom 20, side walls 12,14 and end walls 16,18, a plurality of bottle retaining pockets 36, 38, 40, 42, 44, 46, 48, 50 for retaining bottles such as two-liter plastic bottles.

Preferably, the vertical rib structure 34 includes first, second, and third upwardly projecting columns 52, 54, 56. Accordingly, the various columns 52, 54, 56 cooperate with the pylons 24, 26, 28, 30, 32, and with the case bottom 20, to form the bottle retaining pockets 36, 38, 40, 42, 44, 46, 48, 50.

Figure 3:
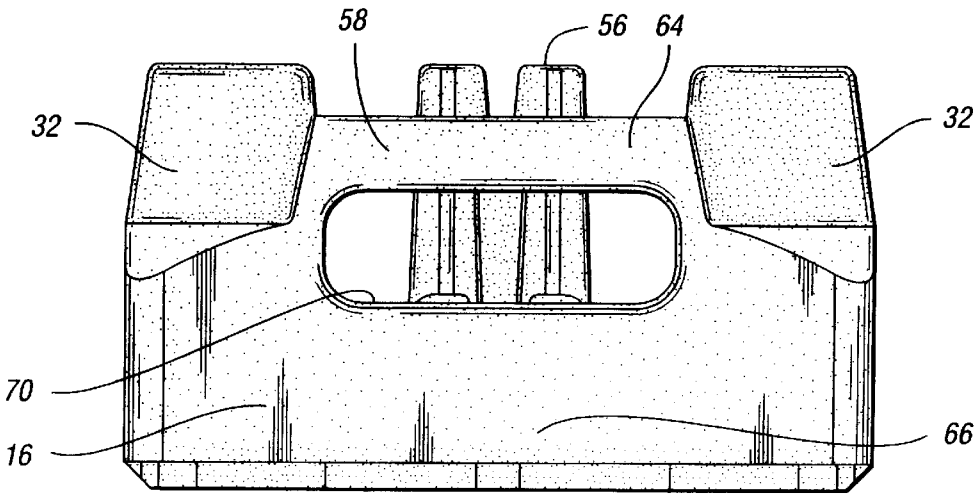
FIG. 3 shows an end view of the case of FIG. 1.

Referring to FIGS. 1 and 3, the end walls 16,18 each comprise an integrally molded handle structure 58,60 having interior and exterior surfaces 62,64, respectively, as shown in FIG. 4, suspended between an upper portion of adjacent corner pylons 32 or 24. A generally open area is defined below the interior and exterior surfaces 62,64 of the handle structures 58,60 and between the interior surfaces 62 of the handle structure 58,60 and the adjacent column 56,52 respectively, such that the handle structure 58,60 may be freely grasped about substantially the entire periphery thereof.

Referring to FIGS. 1 and 3, the present invention is particularly characterized by the integrally molded structural reinforcement members 66,68 extending between the adjacent corner pylons, 32 or 24, below the respective handle structure 58,60. Such structural reinforcement members 66,68 are sufficiently spaced from the respective handle structure 58,60 to prevent interference with the grasping of the handle structure. Because the crates are subject to shipping, handling, fork lift manipulation, etc., it is desirable to heavily reinforce the handle ends. The structural reinforcement members 66,68 provided in the present invention add significant structural integrity to the case 10, thereby substantially increasing the expected usable life of the case 10. A case full of eight two-liter bottles can place the ends of the crate under significant torsional and bending forces, however, the reinforcement members 66,68 alleviate adverse effects of such forces.

Referring to FIG. 3, the opening 70 between the handle structure 58 and reinforcement member 66, for example, presents a molding problem because the core and cavity of the injection molding tool used to manufacture the part is not simply an "open-and-close" tool. Rather, features such as a collapsible core and slide mechanism are required at each end of the crate to mold-in such structure.

As shown in FIG. 1, the reinforcement members 66,68 also include a horizontally extending surface 72,74, respectively, which provides additional torsional strength.

In this embodiment, the reinforcement members 66,68 extend down to the case bottom 20. The reason for this configuration is that the crates are sometimes conveyed on conveyor belts with upstanding tabs used to engage the crate for stopping the conveyor. Accordingly, the reinforcement members 66,68 will engage the upstanding tabs to stop the conveyor.

Also, the handles 58,60 are spaced down approximately 1 inch from the tops of the pylons 24,32 for improved nesting.

Turning to FIG. 5, another feature of the invention is illustrated. As shown, each corner of the case 10 includes a reinforcement rib 78, 80, 82, 84, which not only adds additional strength to the case 10, but also prevents entry of a bottle cap through the bottom of the case. For example, if the case 10 were slid across a plurality of bottles which are supported within cases positioned thereunder, the ribs 78, 80, 82, 84 would prevent entry of a bottle cap through the bottom surface of the case 10 because the ribs 78, 80, 82, 84 are sufficiently close to adjacent ribs so that insufficient space is provided for such passage of a bottle cap. Therefore, free sliding motion of the case 10 across a plurality of stacked bottles is enabled.

Figure 6:
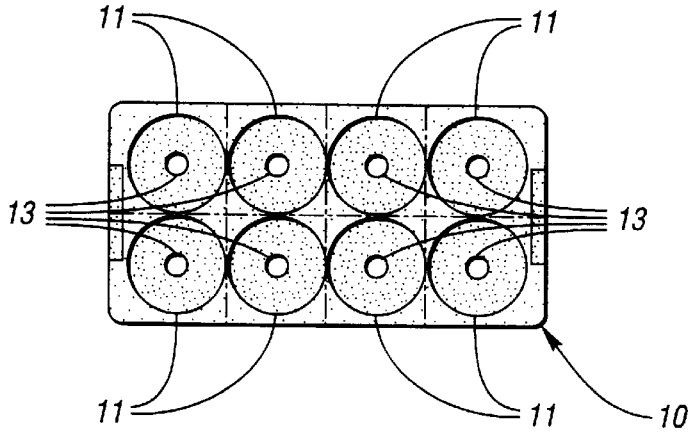
FIG. 6 shows an overhead plan view of a case loaded with bottles in accordance with the embodiment of FIG. 1.
Figure 7:
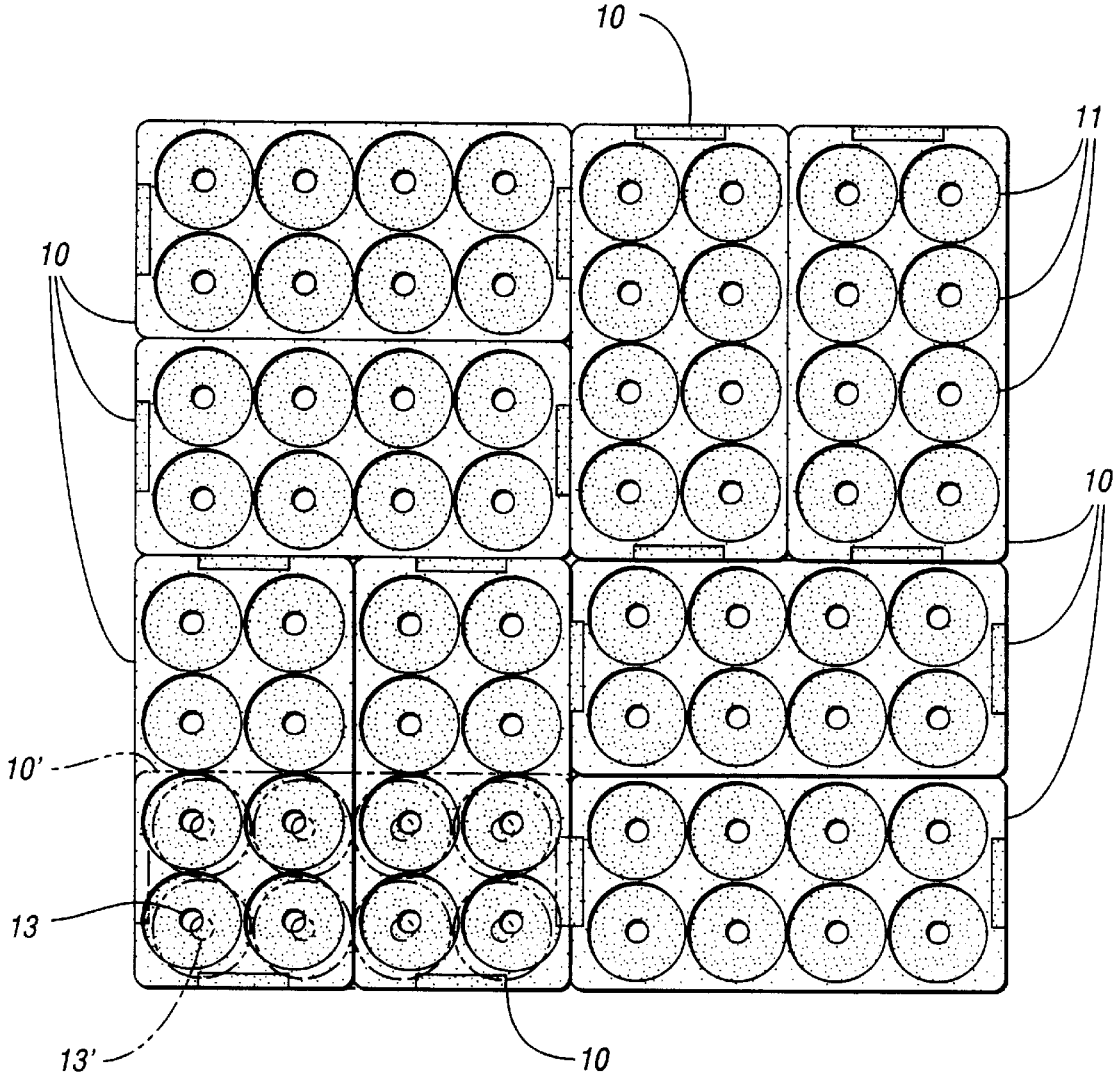
FIG. 7 shows an overhead plan view of a plurality of stacked cases loaded with bottles in accordance with the embodiment of FIG. 1.

Referring to FIGS. 6 and 7, top plan views are shown, respectively, of a case 10 loaded with bottles 11 having bottle caps 13, and a layer of stacked cases 10 loaded with bottles 11. In this configuration, the bottle pockets are arranged so that the 2 liter bottles contact each other when the case is loaded, thereby minimizing the size of each case. However, when the cases are cross-stacked, as illustrated by the case 10' shown in dashed lines, the bottle caps 13,13' of the stacked cases are misaligned throughout the cross-stacked pallets. Accordingly, the case bottoms 20 must have clover-shaped bottle cap locating areas 17, as shown in FIG. 5, to receive the bottle caps from the case immediately below for improved stacking stability. This provides approximately 130° to 150° of bottle cap containment.

Referring to FIGS. 8–14, a case 110 is shown in accordance with an alternative embodiment of the invention. The case 110 is in many respects similar to that shown in FIGS. 1–7. The case 110 includes side walls 112,114 and end walls 116,118. A case bottom 120 is attached to the side walls 112,114 and end walls 116,118 to form the outer shell of the case 110.

A plurality of pylons 124, 126, 128, 130, 132 are provided adjacent the lower wall portion 122 of the side walls 112,114 on both sides of the case 110, including corner pylons 124,132 which form the four corners of the case 110.

Figure 8:
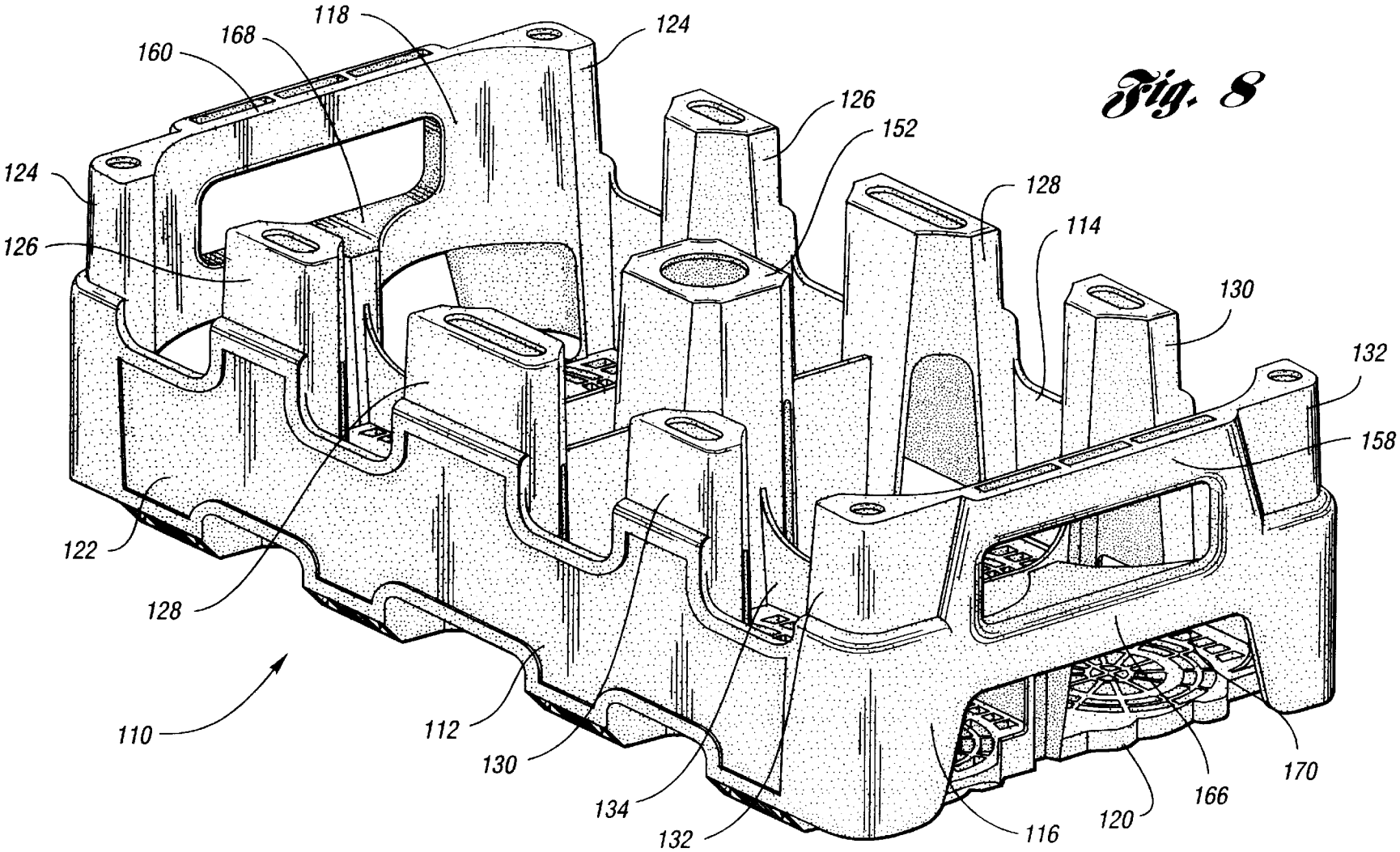
FIG. 8 shows a perspective view of a case in accordance with an alternative embodiment of the invention.
Figure 9:
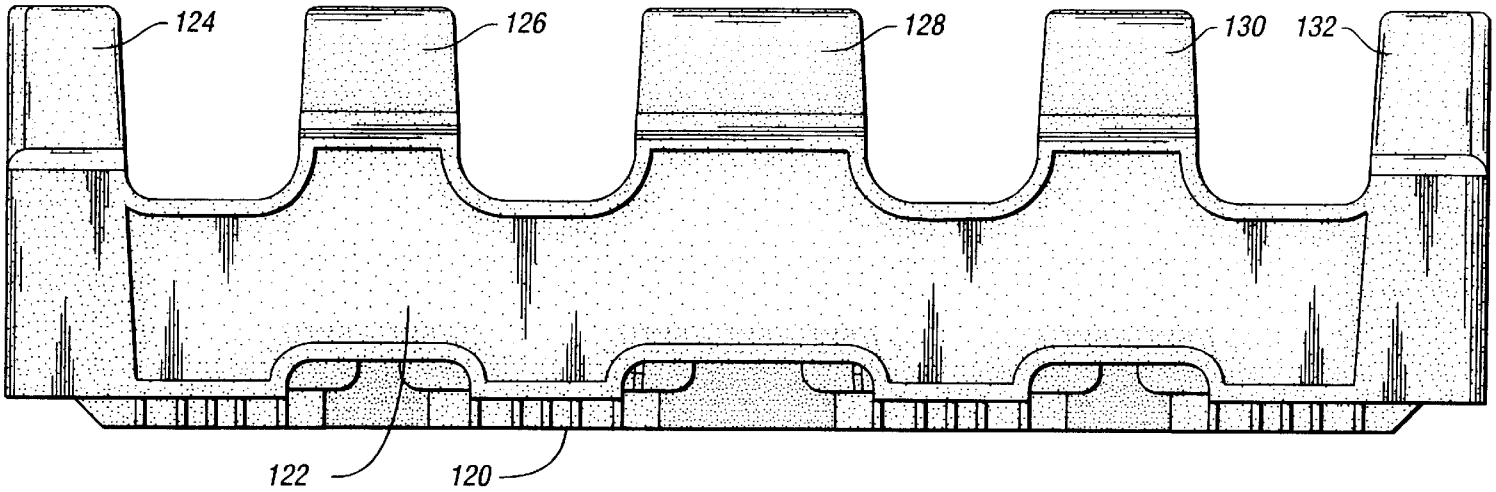
FIG. 9 shows a side-view of the case of FIG. 8.
Figure 11:
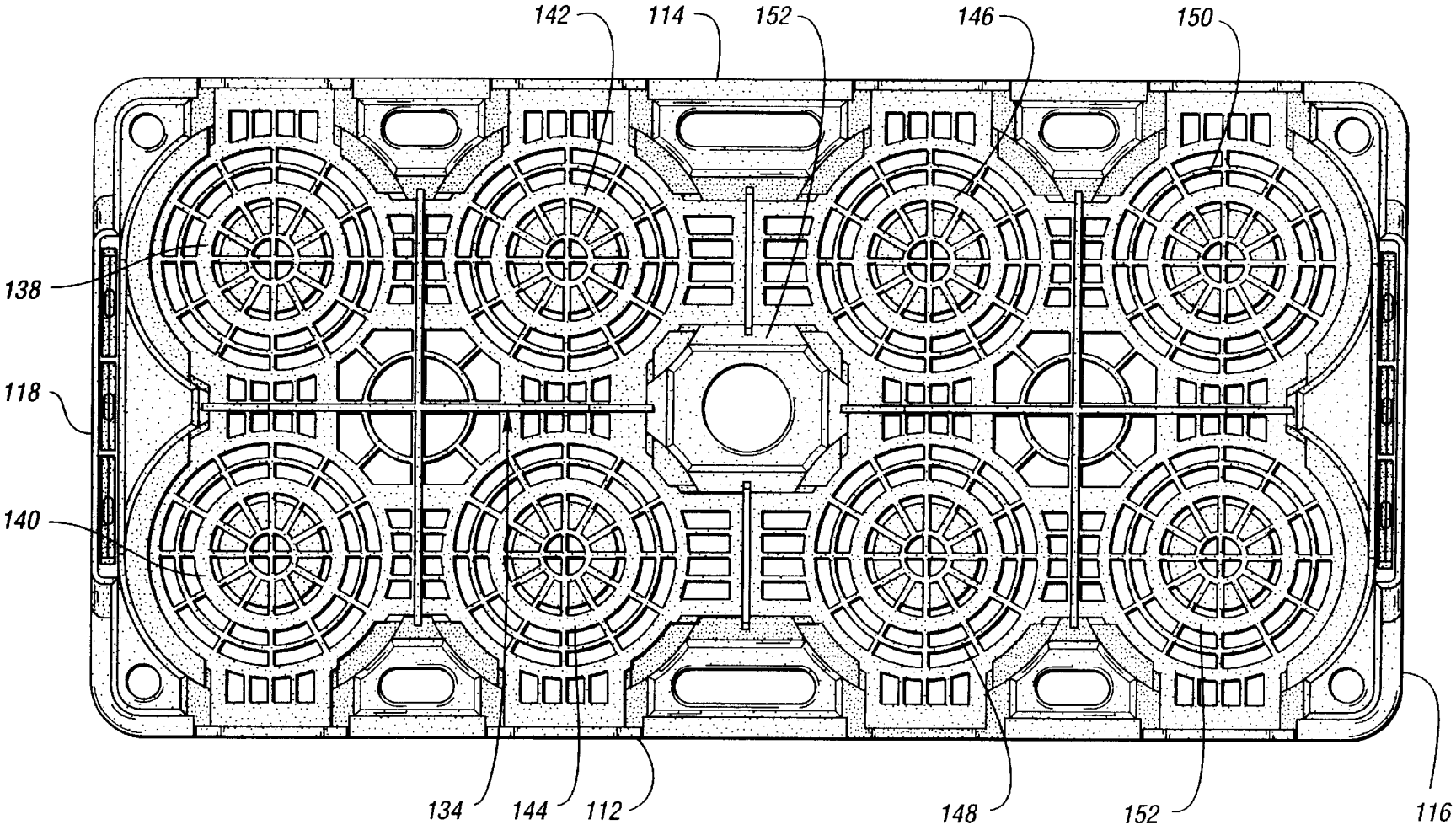
FIG. 11 shows a top plan view of the case of FIG. 8.
Figure 12:
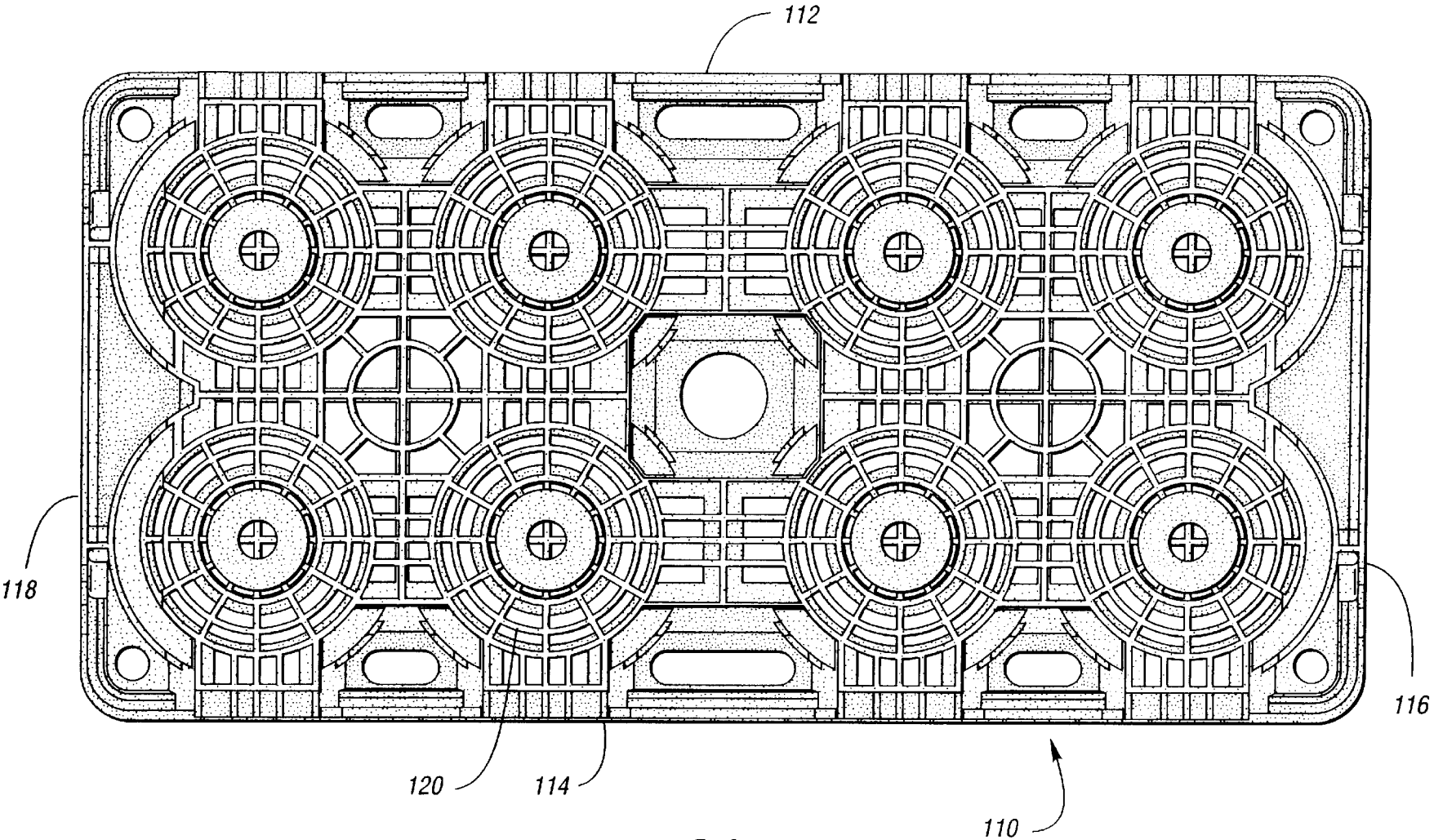
FIG. 12 shows a bottom view of the case of FIG. 8.

The vertical rib structure 134 includes a plurality of ribs which cooperate with the various pylons to form the bottle retaining pockets 136, 138, 140, 142, 144, 146, 148, 150, as shown in FIG. 11. As shown in FIGS. 8 and 11, the vertical rib structure 134 includes a single column 152 in the center of the case 110.

As shown in FIG. 8, the case 110 includes handle structures 158,160 at opposing ends of the case 110. In this embodiment, the handle structures 158,160 are positioned at the top of the pylons 124,132 to provide a higher center of gravity and a higher grasping position, which results in a more stable and easier-to-carry crate.

Figure 10:
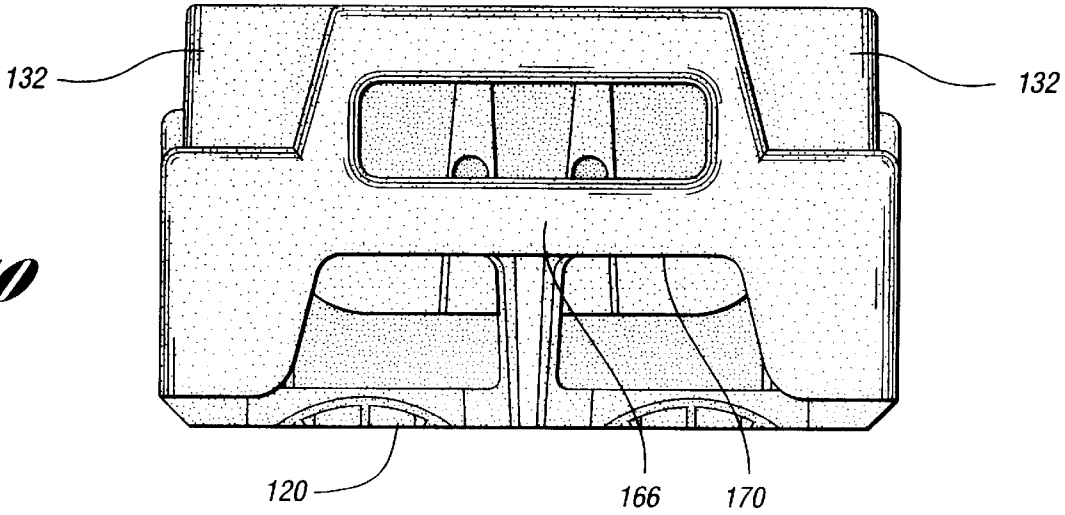
FIG. 10 shows an end view of the case of FIG. 8.

The opposing ends 116,118 of the case 110 also include reinforcement members 166,168 spaced sufficiently away from the respective handle structures 158,160 so as not to interfere with grasping of the handle structures 158,160. As shown in FIGS. 8 and 10, the reinforcement members 166,168 include a lower edge 170 bordering a cut-out portion at the bottom of each opposing end 116, 118. Accordingly, the reinforcement members 166,168 do not extend to the case bottom 120. The cut out portion 170 improves nesting capability by enabling a deeper engagement between adjacent nested crates.

The pylons and column structures provided in the embodiments described herein also facilitate stacking of adjacent cases on top of each other when empty.

Figure 13:
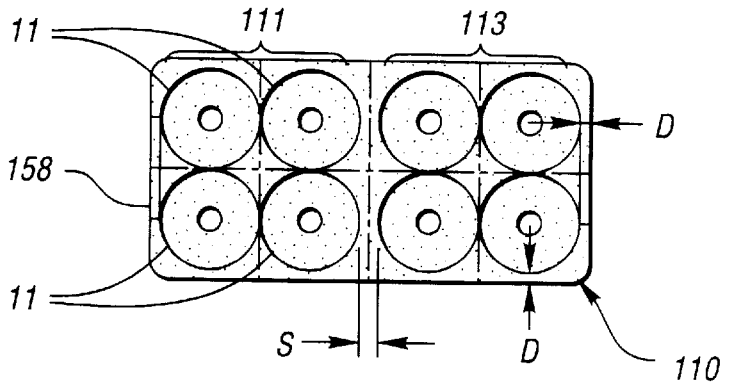
FIG. 13 shows an overhead plan view of a case loaded with bottles in accordance with the embodiment of FIG. 8.

In this embodiment, the bottle retaining pockets are formed in groups of four which are equally spaced within the case and between adjacent cases to provide 360° of support for bottle caps in cone-type locating areas (as opposed to the previously described clover-shaped locating areas 17) for improved cross-stacking stability. Referring to FIG. 13, each case 110 includes two groups 111,113 of equally spaced groups of four bottle retaining pockets for holding four bottles in contact with each other. The two groups of bottles 111,113 are spaced apart by a distance S, which is twice the distance D of the side of each bottle from the periphery of the case 110.

Figure 14:
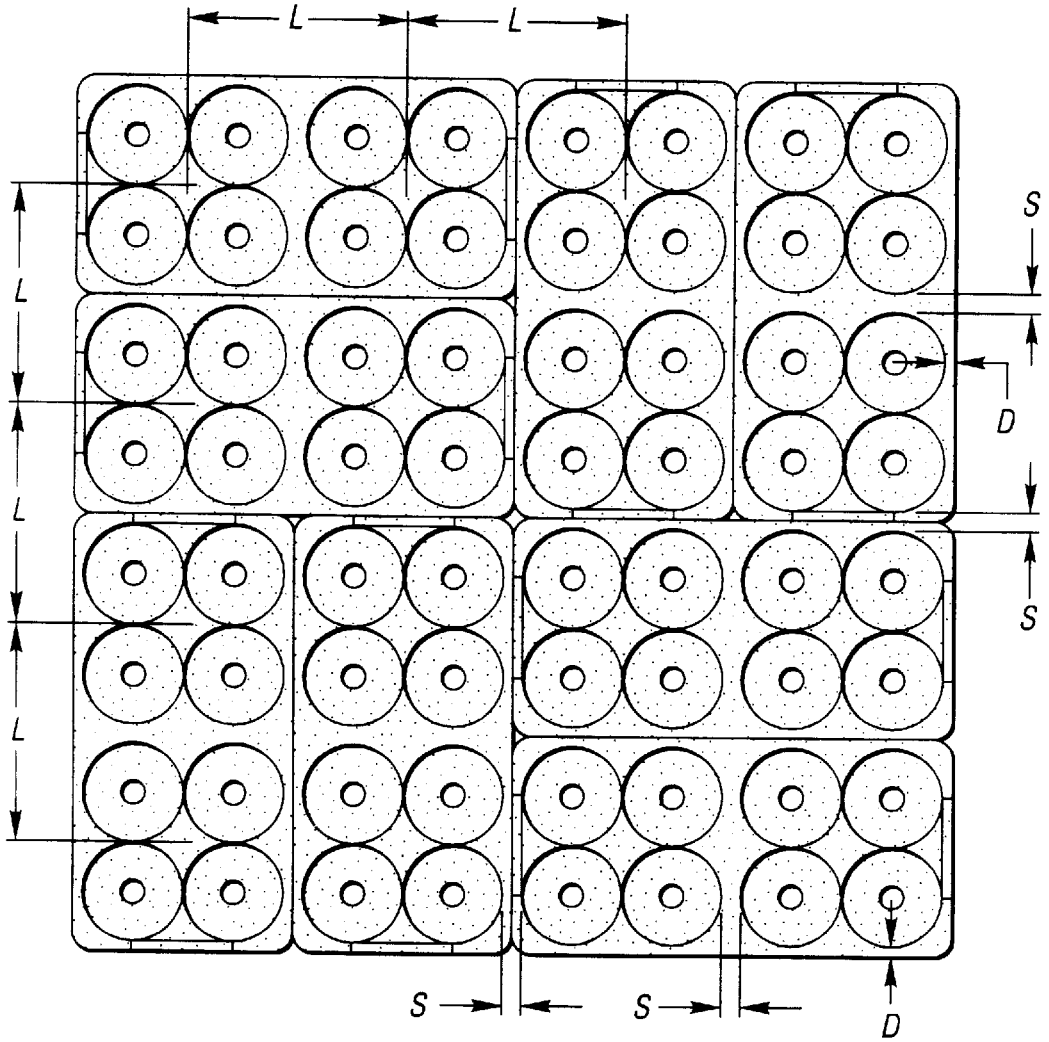
FIG. 14 shows an overhead plan view of a plurality of stacked cases loaded with bottles in accordance with the embodiment of FIG. 8.
Figure 15:
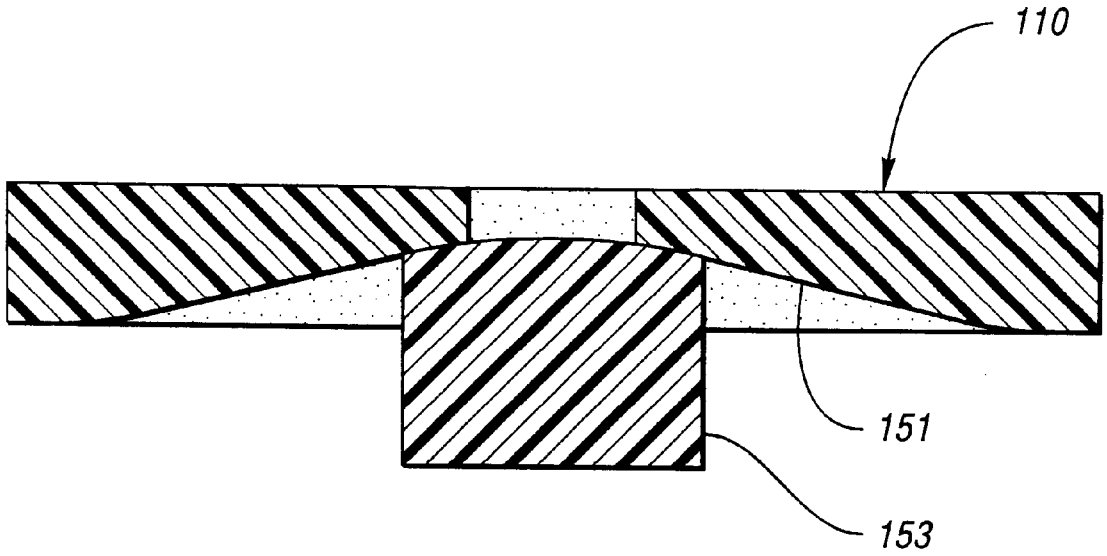
FIG. 15 shows a schematic sectional view of a bottle cap and cap locating area in accordance with the embodiment of FIG. 8.

By maintaining an equal distance between groups of four bottles within the case and between adjacent stacked cases, all bottle caps are vertically aligned in stacks, even when the cases are cross-stacked. As shown in FIG. 14, the distance L between groups of four bottles is maintained throughout the adjacent cases, which provides bottle cap alignment when the cases are cross-stacked. This configuration allows the use of cone-type bottle cap receiving areas 151 on the bottom of each case, shown in FIG. 15, to provide 360° of support on each bottle cap 153, which improves stacking stability. As shown, the cap 153 is always centered in the cone-shaped bottle cap receiving areas 151, which resists lateral movement in all directions.

While the best modes for carrying out the invention have been described in detail, those familiar with the art to which this invention relates will recognize the various alternative designs and embodiments for practicing the invention within the scope of the appended claims.

What is claimed is:

1. In a stackable and nestable low depth case for retaining and transporting bottles comprising opposing side walls and opposing end walls forming an outer shell, and a case bottom disposed substantially within said outer shell; the improvement comprising:

the side walls including a lower wall portion and a plurality of spaced upwardly projecting pylons, including four corner pylons defining four corners of the case;

a vertical rib structure generally disposed within the outer shell defining, in combination with the case bottom, the side walls and the end walls, a plurality of bottle retaining pockets, said pylons extending above said lower wall portions;

said end walls each comprising an integrally molded handle structure having interior and exterior surfaces suspended between an upper portion of adjacent said corner pylons, a generally open area being defined below said interior and exterior surfaces of said handle structure and between said interior surface of said handle structure and a first portion of said vertical rib structure such that said handle structure may be freely grasped about substantially the entire periphery thereof;

said end walls each further comprising an integrally molded structural reinforcement member extending between said adjacent corner pylons below the respective handle structure and sufficiently spaced from the respective handle structure to prevent interference with said grasping of the handle structure; and wherein a top surface of each said corner pylon is coplanar with a top surface of each said handle structure, and a cut-out portion is formed beneath the structural reinforcement member to facilitate nesting of adjacent empty cases.

2. The stackable case of claim 1, wherein said vertical rib structure further comprises at least one upwardly projecting column.

3. The stackable case of claim 1, wherein said handle structure and said pylons are substantially the same height.

4. The stackable case of claim 1, wherein said plurality of bottle retaining pockets comprise two sets of four pockets configured to support two sets of four equally spaced bottles such that the two sets of four equally spaced bottles retained therein would be separated by a separation distance (S), and such that each of such retained bottles would be spaced from a peripheral edge of the case by a distance (D) which is one-half of the separation distance (S), thereby providing bottle alignment in cross-stacked cases.

5. The stackable and nestable low depth case of claim 1, wherein each of said four corner pylons extends at least approximately one inch above a top surface of each handle structure to facilitate nesting of adjacent empty cases.

* * * * *